US010690385B2

(12) United States Patent
Gotou

(10) Patent No.: US 10,690,385 B2
(45) Date of Patent: Jun. 23, 2020

(54) ROTARY COMPRESSOR AND REFRIGERATING CYCLE DEVICE HAVING BEARINGS CONTAINING ANNULAR GROOVE/ELASTIC PORTION ARRANGEMENT

(71) Applicant: TOSHIBA CARRIER CORPORATION, Kawasaki-shi, Kanagawa-ken (JP)

(72) Inventor: Shinya Gotou, Fuji Shizuoka (JP)

(73) Assignee: TOSHIBA CARRIER CORPORATION, Kawasaki-shi (JP)

( * ) Notice: Subject to any disclaimer, the term of this patent is extended or adjusted under 35 U.S.C. 154(b) by 311 days.

(21) Appl. No.: 15/891,447

(22) Filed: Feb. 8, 2018

(65) Prior Publication Data

US 2018/0238596 A1 Aug. 23, 2018

(30) Foreign Application Priority Data

Feb. 21, 2017 (JP) ..... 2017-29902

(51) Int. Cl.

| | |
|---|---|
| ***F25B 31/02*** | (2006.01) |
| ***F04C 18/356*** | (2006.01) |
| ***F25B 49/02*** | (2006.01) |
| ***F04C 23/00*** | (2006.01) |
| ***F25B 1/04*** | (2006.01) |
| ***F04C 29/04*** | (2006.01) |
| *F04C 29/12* | (2006.01) |

(52) U.S. Cl.

CPC ..... *F25B 31/026* (2013.01); *F04C 18/3564* (2013.01); *F04C 18/3568* (2013.01); *F04C 23/008* (2013.01); *F25B 1/04* (2013.01); *F25B 49/022* (2013.01); *F04C 23/001* (2013.01); *F04C 29/045* (2013.01); *F04C 29/12* (2013.01); *F04C 2240/52* (2013.01); *F04C 2240/60* (2013.01)

(58) Field of Classification Search

CPC ..... F04C 18/3564; F04C 18/3568; F04C 23/008; F04C 29/045; F04C 29/12; F04C 18/3562; F04C 2240/52; F04C 2240/601; F04C 23/001; F01C 21/02; F25B 1/04; F25B 31/026; F25B 49/022

USPC ..... 418/157, 248; 62/498

See application file for complete search history.

(56) References Cited

U.S. PATENT DOCUMENTS

| | | | |
|---|---|---|---|
| 2011/0067434 | A1 | 3/2011 | Miura et al. |
| 2014/0219833 | A1 | 8/2014 | Kanayama |

FOREIGN PATENT DOCUMENTS

| | | |
|---|---|---|
| CN | 102046981 | 5/2011 |
| CN | 203783900 | 8/2014 |
| JP | 5263360 | 8/2013 |

*Primary Examiner* — Patrick Hamo
*Assistant Examiner* — Paul W Thiede
(74) *Attorney, Agent, or Firm* — Amin, Turocy & Watson, LLP

(57) ABSTRACT

In one embodiment, an annular groove and an elastic portion are formed at an end portion of a main bearing on a side facing a cylinder chamber. An annular groove and an elastic portion is formed at an end portion of the sub-bearing on a side facing the cylinder chamber. A depth of the annular groove of the main bearing is formed larger than that of the sub-bearing. An outer peripheral surface of the elastic portion of the main bearing is formed in a straight shape so that thicknesses of a base portion and a tip portion of the elastic portion are the same. An outer peripheral surface of the elastic portion of the sub-bearing is formed in a tapered shape so that a thicknesses of a base portion of the elastic portion is larger than that of a tip portion of the elastic portion.

8 Claims, 5 Drawing Sheets

ROTARY COMPRESSOR AND REFRIGERATING CYCLE DEVICE HAVING BEARINGS CONTAINING ANNULAR GROOVE/ELASTIC PORTION ARRANGEMENT

CROSS-REFERENCE TO RELATED APPLICATION

This application is based upon and claims the benefit of priority from the prior Japanese Patent Application No. 2017-29902, filed on Feb. 21, 2017, the entire contents of which are incorporated herein by reference.

FIELD

Embodiments described herein relate generally to a rotary compressor which compresses working fluid such as gas refrigerant, and to a refrigerating cycle device using the rotary compressor.

BACKGROUND

A rotary compressor for compressing a gas refrigerant which houses an electric motor and a compression mechanism portion respectively connected with each other via a rotary shaft is disclosed in the Japanese Patent Publication No. 5263360. A refrigerating cycle device which cools and heats air by circulating the gas refrigerant compressed by the rotary compressor through a radiator, an expansion device and a heat-sink is also disclosed in the Patent Publication.

In such a rotary compressor, a rotary shaft is supported rotatably by a main bearing and a sub-bearing which are a pair of bearings. In order to suppress increase of contact pressure between the rotary shaft and the bearings and attrition of the rotary shaft and the bearings, an annular groove and an elastic portion located inside the annular groove are formed in each bearing.

In the rotary compressor, the annular groove provided in the main bearing is formed in a shape of a straight i.e. in a shape of a cylinder so that the width dimension of a bottom portion and the width dimension of a tip portion are the same. The outer peripheral surface of the elastic portion provided in the main bearing is also formed in a shape of a straight so that the width dimension of a base portion and the width dimension of a tip portion are the same. On the other hand, the annular groove provided in the sub-bearing is formed so that the width dimension of a bottom is smaller than the width dimension of a tip portion. The outer peripheral surface of the elastic portion provided in the sub-bearing is formed in a tapered shape so that the width dimension of a base portion is larger than the width dimension of a tip portion. Further, the depth dimension of the annular groove provided in the sub-bearing is formed so that the annular groove of the sub-bearing is larger than the depth dimension of the annular groove formed in the main bearing.

In such a rotary compressor, attrition of an elastic portion of a main bearing and a rotary shaft within a contact range is desired to decrease so that reliability is enhanced.

DETAILED DESCRIPTION

Figure 1:
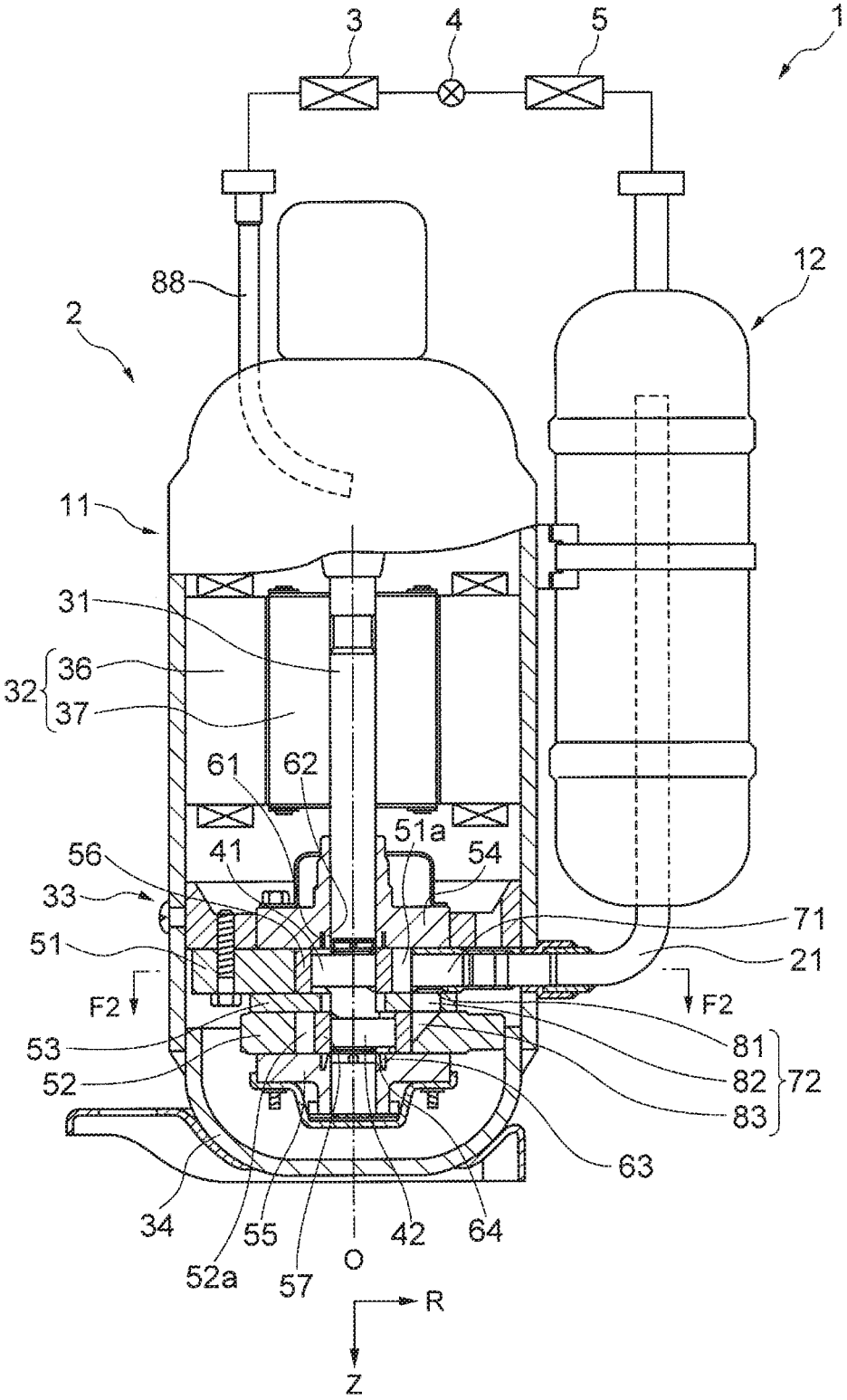
FIG. 1 is a configuration diagram of a refrigerating cycle device according to an embodiment.

A rotary compressor according to an embodiment includes a rotary shaft, an electric motor portion, a compression mechanism portion and a hermetic case. The electric motor portion is connected with one end of the rotary shaft. The compression mechanism portion is connected with the other end of the rotary shaft, and has a cylinder in which a cylinder chamber is formed and the main bearing and the sub-bearing support the rotary shaft rotatably. The main bearing is positioned at a side of the cylinder chamber which is directed to the electric motor portion. The sub-bearing is positioned at a side of the cylinder chamber which is opposite to the electric motor portion. The hermetic case houses the rotary shaft, the electric motor portion and the compression mechanism portion.

The diameters of portions of the rotary shaft supported by the main bearing and the sub-bearing are formed to be the same substantially. The contact length of the main bearing and the rotary shaft along an axial direction of the rotary shaft is set to be larger than the contact length of the sub-bearing and the rotary shaft along the axial direction of the rotary shaft. An annular groove is formed at an end portion of the main bearing on a side facing the cylinder chamber. An elastic portion which contact the rotary shaft is formed at an inner peripheral side of the annular groove of the main bearing. Another annular groove is formed at an end portion of the sub-bearing on a side facing the cylinder chamber. An elastic portion which contact the rotary shaft is formed at an inner peripheral side of the annular groove of the sub-bearing.

The depth of the annular groove of the main bearing is formed to be larger than the depth of the annular groove of the sub-bearing. An outer peripheral surface of the elastic portion of the main bearing is formed in a straight shape so that thicknesses of a base portion and a tip portion of the elastic portion are the same substantially. An outer peripheral surface of the elastic portion of the sub-bearing is formed in a tapered shape so that a thicknesses of a base portion of the elastic portion is larger than a thicknesses of a tip portion of the elastic portion.

Hereinafter, further embodiments will be described with reference to the drawings. In the drawings, the same reference numerals denote the same or similar portions respectively.

A refrigerating cycle device according to the embodiment will be described with reference to FIG. 1. FIG. 1 is a diagram showing a schematic configuration of the refrigerating cycle device.

As shown in FIG. 1, the refrigerating cycle device 1 is provided with a rotary compressor 2, a radiator 3 such as a condenser connected to the rotary compressor 2, an expansion device 4 such as an expansion valve connected to radiator 3, and a heat sink 5 such as an evaporator connected between the expansion device 4 and the rotary compressor 2.

The rotary compressor 2 is the so-called rotary-type compressor. The rotary compressor 2 can compress a low-pressure gas refrigerant i.e. a working fluid introduced into an inside of the rotary compressor 2, and change the low-pressure gas refrigerant into a high temperature and high-pressure gas refrigerant.

The radiator 3 radiates heat from the high temperature and high-pressure gas refrigerant supplied from the rotary compressor 2, and changes the high temperature and high-pressure gas refrigerant into a high-pressure liquid refrigerant.

The expansion device 4 lowers the pressure of the high-pressure liquid refrigerant supplied from the radiator 3, and changes the high-pressure liquid refrigerant into a low temperature and low-pressure liquid refrigerant.

The heat sink 5 evaporate the low temperature and low-pressure liquid refrigerant supplied from expansion device 4 to make a low-pressure gas refrigerant. When the low temperature and low-pressure liquid refrigerant evaporates at a low temperature in the heat sink 5, the circumference is cooled by drawing evaporation heat from the circumference. A low-pressure gas refrigerant which passes the heat sink 5 is supplied to the inside of the rotary compressor 2.

In the refrigerating cycle device 1 of the embodiment, the refrigerant which is a working fluid circulates, while phase-changing between a gas refrigerant and a liquid refrigerant. Heat is radiated in a process in which a phase-change is performed from a gas refrigerant to a liquid refrigerant, and heat is absorbed in a process in which a phase-change is performed from a fluid refrigerant to a gas refrigerant. Heating and cooling air etc. are performed using these heat radiation and heat-absorption.

A detailed configuration of the rotary compressor 2 will be described. The rotary compressor 2 is provided with a main body 11 of the compressor and an accumulator 12. The accumulator 12 is the so-called vapor-liquid separating device. The accumulator 12 is provided between the heat sink 5 and main body 11 of the compressor, and is connected to the main body 11 of the compressor through a suction pipe 21. The accumulator 12 supplies a gas refrigerant evaporated by the heat sink 5 to the main body 11 of the compressor through the suction pipe 21.

The main body 11 of the compressor is provided with a rotary shaft 31, an electric motor portion 32, a compression mechanism portion 33 and a cylindrical hermetic case 34 which houses the rotary shaft 31, the electric motor portion 32 and the compression mechanism portion 33. The electric motor portion 32 is connected with one end side of the rotary shaft 31 and rotates the rotary shaft 31. The compression mechanism portion 33 is connected with the other end side of the rotary shaft 31 and compresses a gas refrigerant by rotation of the rotary shaft 31.

Figure 2:
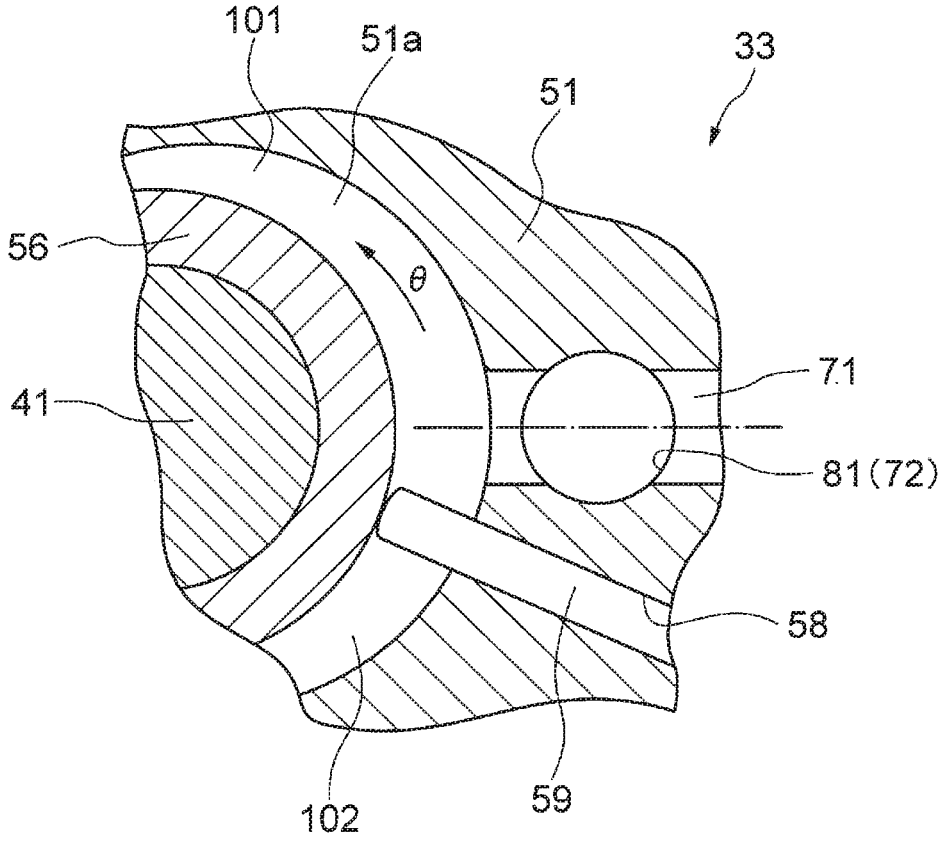
FIG. 2 is a view of a horizontal section which shows a portion of compression mechanism portion shown in FIG. 1.

The rotary shaft 31 and the hermetic case 34 are arranged coaxially with an axial center ○ i.e. an axial line of the rotary shaft 31. The axial center ○ of the rotary shaft 31 means a center i.e. a rotation center of the rotary shaft 31. In the hermetic case 34, the electric motor portion 32 is arranged at one end side in a direction along the axial center ○, i.e., at an upper side in FIG. 1. In the hermetic case 34, the compression mechanism portion 33 is arranged at the other end side in the direction along the axial center ○, i.e., at a lower side in FIG. 1. In the following explanation, the direction along the axial center ○ will be mentioned as an axial direction Z of the rotary shaft 31. A direction which intersects with the axial center ○ perpendicularly and is directed away from the axial center ○ radially will be mentioned as a radial direction R of the rotary shaft 31. A direction which rotates around the axial center ○ while maintaining a constant distance with respect to the axial center ○ will be mentioned as a circumferential direction θ of the rotary shaft 31. The circumferential direction θ is shown in FIG. 2 which is explained below.

Along the axial direction Z, the rotary shaft 31 penetrates the electric motor portion 32 and extends to an inside of the compression mechanism portion 33. At the rotary shaft 31, a first eccentric portion 41 and a second eccentric portion 42 are provided to be lined with each other in the axial direction Z. The first eccentric portion 41 is arranged at a position of the rotary shaft 31 corresponding to a first cylinder 51 of the compression mechanism portion 33. The second eccentric portion 42 is arranged at a position of the rotary shaft 31 corresponding to a second cylinder 52 of the compression mechanism portion 33 which is described below. Each of the first eccentric portion 41 and the second eccentric portion 42 is a columnar member extending along the axial direction Z, for example. The first eccentric portion 41 and the second eccentric portion 42 are positioned apart from the axial center ○ in the radial direction R by the same amount. The first eccentric portion 41 and the second eccentric portion 42 are formed in the same shape and size, for example, in a planar view seen from the axial direction Z, and are arranged so as to have a 180° phase difference in the circumferential direction θ, for example.

The electric motor portion 32 is the so-called inner rotor type DC brushless motor, for example. Specifically, the electric motor portion 32 is provided with a stator 36 and a rotor 37. The stator 36 is formed in a cylinder shape and is fixed to an inner peripheral wall of the hermetic case 34 by shrinkage fitting etc. The rotor 37 is arranged inside the stator 36. The rotor 37 is connected with an upper portion of the rotary shaft 31. The rotor 37 is driven to rotate the rotary shaft 31 by supplying current through a coil provided in the stator 36.

The compression mechanism portion 33 will be described. The compression mechanism portion 33 is provided with the first cylinder 51 and the second cylinder 52 as a plurality of cylinders, a divider plate 53, a main bearing 54, a sub-bearing 55, and a first roller 56 and a second roller 57 as a plurality of rollers.

The first cylinder 51 and the second cylinder 52 are lined with each other in the axial direction Z with a distance between the first cylinder 51 and the second cylinder 52. Each of the first cylinder 51 and the second cylinder 52 is formed in a cylinder shape which is open in the axial direction Z. An interior space is formed as a first cylinder chamber 51*a* in the first cylinder 51. In the first cylinder chamber 51*a*, the first eccentric portion 41 of the rotary shaft 31 is arranged. Similarly, an interior space is formed as a second cylinder chamber 52*a* in the second cylinder 51. In the second cylinder chamber 52*a*, the second eccentric portion 42 of the rotary shaft 31 is arranged. A structure for supplying a gas refrigerant to the first cylinder chamber 51*a* and the second cylinder chamber 52*a* will be described below.

The divider plate 53 is arranged between the first cylinder 51 and the second cylinder 52 in the axial direction Z so as to contact the first cylinder 51 and the second cylinder 52. The divider plate 53 faces the first cylinder chamber 51*a* in the axial direction Z and forms one surface of the first cylinder chamber 51*a*. Similarly, the divider plate 53 faces the second cylinder chamber 52*a* in the axial direction Z and forms one surface of the second cylinder chamber 52*a*. The divider plate 53 has an opening portion through which the rotary shaft 31 is inserted in the axial direction Z.

The main bearing 54 is located at a side of the electric motor portion 32 in the compression mechanism portion 33 and at a side of the first cylinder 51 opposite to the divider plate 53. The main bearing 54 faces the first cylinder chamber 51*a* from a side opposite to the divider plate 53, and forms one surface of the first cylinder chamber 51. On the other hand, the sub-bearing 55 is located at a side opposite to the electric motor portion 32 in the compression mechanism portion 33 and at a side of the second cylinder 52 opposite to the divider plate 53. The sub-bearing 55 faces the second cylinder chamber 52*a* from a side opposite to the divider plate 53, and forms one surface of the second cylinder chamber 52*a*. The rotary shaft 31 mentioned above penetrates the first cylinder chamber 51, the second cylinder of 52 and the divider plate 53, and is supported by the main bearing 54 and the sub-bearing 55 rotatably.

The rotary shaft 31 is formed so that the diameter of a main shaft portion supported by the main bearing 54 rotatably and the diameter of the sub-shaft portion supported by sub-bearing 55 rotatably are the same substantially. The contact length of the main bearing 54 and the rotary shaft 31 along the axial direction Z of the rotary shaft 31 is set larger than the contact length of the sub-bearing 55 and the rotary shaft 31 along the axial direction Z of the rotary shaft 31. Further, the clearance dimension between an inner peripheral surface of the main bearing 54 and an outer peripheral surface of the main shaft portion of the rotary shaft 31 is set larger than the clearance dimension between an inner peripheral surface of the sub-bearing 55 and an outer peripheral surface of the sub-shaft portion of the rotary shaft 31.

Figure 4:
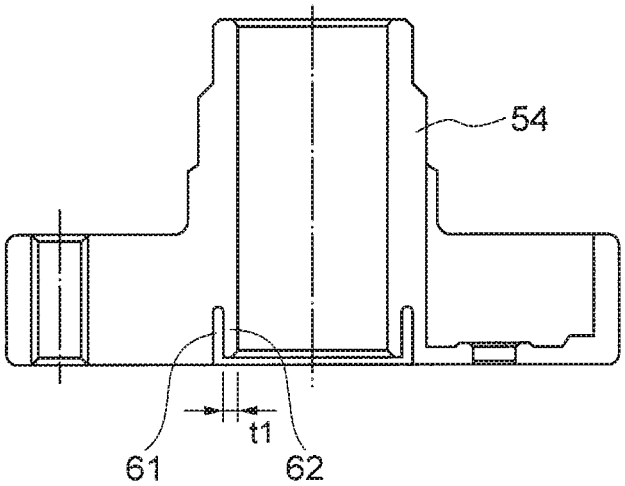
FIG. 4 shows a longitudinal section of a main bearing which includes an annular groove and an elastic portion.
Figure 5:
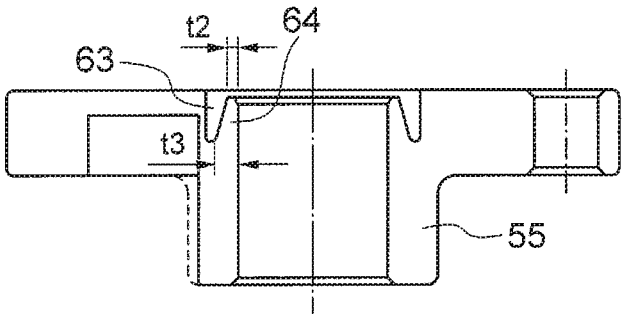
FIG. 5 shows a longitudinal section of a sub-bearing which has an annular groove and an elastic portion.

As shown in FIGS. 1, 4, an annular groove 61 as a first annular groove and an elastic portion 62 as a first elastic portion are formed at an end portion of the main bearing 54 on a side facing the first cylinder chamber 51*a*. The elastic portion 62 is located at an inner peripheral side of the annular groove 61 and contacts the rotary shaft 31. As shown in FIGS. 1, 5, an annular groove 63 as a second annular groove and an elastic portion 64 as a second elastic portion are formed at an end portion of the sub-bearing 55 on a side facing the second cylinder chamber 52*a*. The elastic portion 64 is located at an inner peripheral side of the annular groove 63 and contacts the rotary shaft 31.

The depth of the annular groove 61 is formed larger than the depth of the annular groove 63.

The annular groove 61 is formed in a shape of a straight i.e. a cylinder so that the width dimension of a bottom portion (an upper portion in FIG. 4) of the groove 61 and the width dimension of a tip portion (a lower portion in FIG. 4) of the groove 61 are the same substantially. An outer peripheral surface of the elastic portion 62 is formed in a shape of a straight i.e. a cylinder so that the thickness of a base portion of the elastic portion 62 located to adjoin the bottom portion of the annular groove 61 and the thickness of a tip portion of the elastic portion 62 have the same value t1 substantially.

The annular groove 63 is formed in a shape of a tapered shape so that the width dimension of a bottom portion (a lower portion in FIG. 5) of the groove 63 is narrower than the width dimension of a tip portion (an upper portion in FIG. 5) of the groove 63. An outer peripheral surface of the elastic portion 64 is formed in a shape of a tapered shape so that the thickness t3 of a base portion of the elastic portion 64 located to adjoin the bottom portion of the annular groove 63 is larger than the thickness t2 of a tip portion of the elastic portion 64.

Comparing the elastic portion 62 with the elastic portion 64, the thickness t3 of the base portion of the elastic portion 64 is formed larger than the thickness t1 of the elastic portion 62, and the thickness t2 of the tip portion of the elastic portion 64 is formed smaller than the thickness t1 of the elastic portion 62.

In FIG. 1, each of the first roller 56 and the second roller 57 is formed in a cylinder shape along the axial direction Z. The first roller 56 is fitted in the first eccentric portion 41 and is arranged in the first cylinder chamber 51*a*. Similarly, the second roller 57 is fitted in the second eccentric portion 42 and is arranged in the second cylinder chamber 52*a*. Clearances which permits relative rotation of the rollers 56, 57 with respect to the eccentric portions 41, 42 are respectively provided between inner peripheral surfaces of the rollers 56, 57 and outer peripheral surfaces of the eccentric portions 41, 42. In other words, the word "fitted" means to include not only a case in which two members are fixed, but also a case in which a clearance which permits mutual rotation exists between the two members. Eccentric rotation of the first roller 56 and the second roller 57 is carried out in the cylinder chamber 51*a* and 52*a* while making the outer peripheral surface of each of the rollers 56, 57 contact the inner peripheral surface of each of the cylinders 51, 52 slidably, with rotation of rotary shaft 31.

An internal configurations of the cylinders 51, 52 will be explained based on FIG. 2. The internal configurations of the cylinders 51, 52 are the same approximately, except for first and second suction passages 71, 72 mentioned below and portions which differs in accordance with phase differences of the eccentric portions 41, 42 and the rollers 56, 57. Thus, hereinafter, the internal configuration of the first cylinder 51 will be explained representatively.

FIG. 2 is a partial sectional view of the compression mechanism portion 33 of FIG. 1. FIG. 2 shows a partial section taken along a plane F2-F2. As shown in FIG. 2, a vane groove 58 which extends towards an outside in the radial direction R is provided in the first cylinder of 51. A vane 59 which is slidable along the radial direction R is inserted in the vane groove 58. The vane 59 is energized towards an inner side in the radial direction R by an energizing means (not illustrated), and a tip portion of the vane 59 contacts the outer peripheral surface of the first roller 56 in the first cylinder chamber 51*a*. By such a configuration, the vane 59 divides the interior of the first cylinder chamber 51*a* into a suction chamber 101 and a compression chamber 102 in the circumferential direction θ of the rotary shaft 31. The vane 59 moves forward and backward in the first cylinder chamber 51*a* with eccentric rotation of the first roller 56. Accordingly, when eccentric rotation of the first roller 56 is carried out in the first cylinder chamber 51*a*, compression operation which compresses a gas refrigerant in the first cylinder chamber 51*a* is performed by the eccentric rotation of the first roller 56 and the associated forward and backward movement of the vane 59. The gas refrigerant compressed in the first cylinder chamber 51*a* is discharged through the discharge hole (not shown) of the first cylinder 51 to an outside space in the hermetic case 34. As a result, the interior of the hermetic case 34 is filled with the gas refrigerant. The gas refrigerant in the hermetic case 34 is supplied to the radiator 3 through a discharge pipe 88.

A structure for supplying a gas refrigerant (a working fluid) to the first cylinder 51 and the second cylinder 52 will be described. As shown in FIG. 1, the suction pipe 21 is connected only to the cylinder 51 of the two cylinders 51, 52 which are lined with each other in the axial direction, in the rotary compressor 2 of the embodiment. A branch flow channel is provided in the interior of the compression mechanism portion 33. The branch flow channel leads part of a gas refrigerant supplied from the suction pipe 21 through the cylinder 51 to the other cylinder 52. These configurations will be explained in detail below.

As described above, in FIG. 1, the suction pipe 21 into which a gas refrigerant flows from the accumulator 12 is connected to the first cylinder 51. A first suction passage 71 which makes the suction pipe 21 communicate with the first cylinder chamber 51*a* is provided in the radial direction R, in the first cylinder 51. The phrase "provided in a radial direction" may be replaced with "provided along a radial direction" or "opened in a radial direction."

In FIG. 2, the first suction passage 71 is a hole which is provided in the radial direction R in the first cylinder, for example. The first suction passage 71 penetrates from an outer peripheral surface of the first cylinder 51 to an inner peripheral surface of the first cylinder 51 which defines the first cylinder chamber 51*a*, for example. The first suction passage 71 leads part of the gas refrigerant supplied from the suction pipe 21 shown in FIG. 1 to the suction chamber 101 of the first cylinder chamber 51*a*.

As shown in FIG. 1, a second suction passage 72 branched from the first suction passage 71 is provided in the compression mechanism portion 33. The second suction passage 72 ranges from the first cylinder 51 through the divider plate 53 to the second cylinder 52 and make the first suction passage 71 communicate with the second cylinder chamber 52*a*. The second suction passage 72 leads part of a gas refrigerant which flows through the first suction passage 71 to the second cylinder chamber 52*a*.

Figure 3:
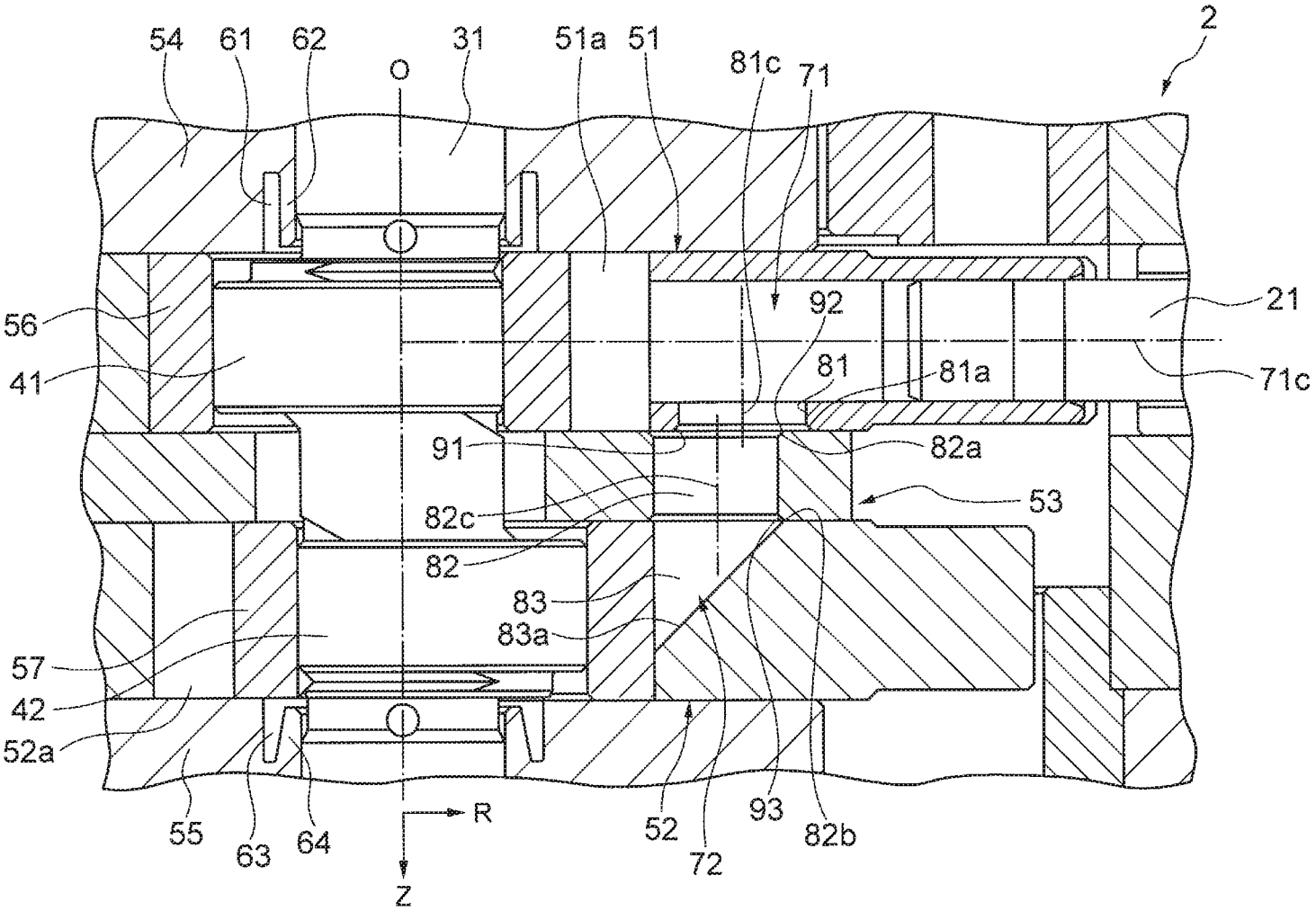
FIG. 3 shows an enlarged and longitudinal section of a portion of the compression mechanism portion.

The second suction passage 72 will be explained in detail. FIG. 3 is an enlarged view of a longitudinal section showing a portion of the compression mechanism portion 33 of the embodiment. As shown in FIG. 3, the second suction passage 72 is formed of a first suction hole 81 provided in the first cylinder 51, a second suction hole 82 provided in the divider plate 53 and a refrigerant flow channel 83 provided in the second cylinder 52, for example.

The first suction hole 81 is provided in the axial direction Z in the first cylinder 51. The phrase "provided in an axial direction" means "opened in an axial direction Z", for example. Thus, the phrase "provided in an axial direction" may be replaced with "provided in an axial direction" or "opened in an axial direction" etc. As shown in FIG. 2, the first suction hole 81 is a round hole having a sectional shape of a circle and an opening in the axial direction Z, for example. As shown in FIG. 3, the first suction hole 81 penetrates from the first suction passage 71 to a surface (an undersurface in FIG. 3) of the first cylinder 51 facing the divider plate 53. The first suction hole 81 makes the first suction passage 71 communicate with the second suction hole 82 provided in the divider plate 53.

A first chamfered portion 91 is provided at an opening edge 81*a* of the first suction hole 81 adjacent to the divider plate 53. The first chamfered portion 91 ranges over an entire circumference of the opening edge 81*a*, for example. By providing the first chamfered portion 91, the opening edge 81*a* has a sloped surface i.e. a diameter expanded portion which is inclined with respect to the axial direction Z. The sectional area i.e. the opening area of the first suction hole 81 is expanded at the first chamfered portion 91.

The second suction hole 82 is provided in the axial direction Z in the divider plate 53. The second suction hole 82 is a round hole having a sectional shape of a circle which is open in the axial direction Z and extends along the axial direction Z, for example. The second suction hole 82 penetrates from a surface (an upper surface in FIG. 3) of the divider plate 53 which faces the first cylinder 51 to another surface (an undersurface in FIG. 3) of the divider plate 53 which faces the second cylinder 52, in the axial direction Z. The second suction hole 82 makes the first suction hole 81 of the first cylinder 51 and the refrigerant flow channel 83 of the second cylinder 52 communicate with each other. The inside diameter of the second suction hole 82 is the same as the inside diameter of the first suction hole 81 substantially. However, the inside diameter of the second suction hole 82 may be larger or smaller than the inside diameter of the first suction hole 81.

A second chamfered portion 92 is provided at an opening edge 82*a* of the second suction hole 82 which adjoins the first cylinder 51. The second chamfered portion 92 ranges over an entire circumference of the opening edge 82*a*, for example. A third chamfered portion 93 is provided at opening edge 82*b* of the second suction hole 82 which faces the second cylinder 52. The third chamfered portion 93 ranges over an entire circumference of the opening edge 82*b*, for example. Accordingly, the opening edges 82*a*, 82*b* have a sloped surface i.e. a diameter expanded portion which is inclined with respect to the axial direction Z. The sectional area i.e. the opening area of the second suction hole 82 is expanded at the second chamfered portion 92 and the third chamfered portion 93 respectively.

The refrigerant flow channel 83 is a groove provided in the second cylinder 52, for example. The refrigerant flow channel 83 penetrates from a surface (an upper surface in FIG. 3) of the second cylinder 52 facing the divider plate 53 to the inner peripheral surface of the second cylinder 52 which defines the second cylinder chamber 52*a*, for example. The refrigerant flow channel 83 makes the second suction hole 82 of the divider plate 53 and the second cylinder chamber 52*a* communicate with each other. The refrigerant flow channel 83 is provided along a direction which inclines with respect to the axial direction Z, for example. The refrigerant flow channel 83 has a sloped surface 83*a* which inclines with respect to the axial direction Z.

By the above configuration, part of the gas refrigerant which flows through the first suction passage 71 passes the first suction hole 81 provided in the first cylinder 51, the second suction hole 82 provided in the divider plate 53 and the refrigerant flow channel 83 provided in the second cylinder 52, and is led to a suction chamber of the second cylinder chamber 52*a* corresponding to the suction chamber 101 of FIG. 2.

The arrangement position of the second suction hole 82 will be explained. As shown in FIG. 3, in the embodiment, the first suction hole 81 and the second suction hole 82 are positioned apart from each other in the radial direction R of the rotary shaft 31. According to the embodiment, the center 81*c* of the first suction hole 81 is located more outside in the radial direction R than the center 82*c* of the second suction hole 82. The center 81*c* of the first suction hole 81 means a center of the first suction hole 81 in the radial direction R of the rotary shaft 31, for example. The center 82*c* of the second suction hole 82 means a center of the second suction hole 82 in the radial direction R of the rotary shaft 31, for example.

An operation of the rotary compressor 2 of the embodiment will be explained with reference to FIGS. 1 to 3. When the rotary compressor 2 is driven and the rotary shaft 31 is rotated, the first roller 56 and the second roller 57 perform eccentric rotation in the first cylinder chamber 51*a* and the second cylinder chamber 52*a*, respectively. Accordingly, a gas refrigerant in the first cylinder chamber 51*a* and the second cylinder chamber 52*a* is compressed and discharged through discharge holes (not shown) of the first cylinder 51 and the second cylinder 52 respectively to an outer space in the hermetic case 34.

When the pressure of the suction chambers of the first cylinder chamber 51*a* and the second cylinder chamber 52*a* becomes low by the eccentric rotation of the first roller 56 and the second roller 57, a gas refrigerant is supplied from the accumulator 12 through the suction pipe 21 to the compression mechanism portion 33. Part of the gas refrigerants supplied from the suction pipe 21 is supplied to the first cylinder chamber 51*a* through the first suction passage 71 provided in the first cylinder 51. Other part of the gas refrigerants which flows through the suction pipe 21 enters into the first suction passage 71, then flows into the second suction passage 72, and is supplied to the second cylinder chamber 52*a*. In the embodiment, as described above, the center 81*c* of the first suction hole 81 which serves as an entrance of the second suction passage 72 is located more outside in the radial direction R than the center 82*c* of the second suction hole 82. Thus, when the first suction hole 81 and the second suction hole 82 are seen in combination, the second suction passage 72 has a configuration similar substantially to an inclined hole inclined with respect to the axial direction Z so that the second suction passage 72 is directed toward the second cylinder chamber 52*a*. Accordingly, the gas refrigerant can flow with inclination with respect to the axial direction Z from the first suction passage 71 toward the second cylinder chamber 52*a*. As a result, the gas refrigerant in the first suction passage 71 can flow into the second cylinder chamber 52*a* smoothly comparatively.

According to such a configuration, manufacturability of a rotary compressor can be enhanced, while achieving high performance of the rotary compressor. In other words, since a gas refrigerant becomes high pressure comparatively in a rotary compressor which uses gas refrigerant such as carbon dioxide, in some cases, a suction pipe is connected to one of two cylinders, and a branch flow channel which leads the gas refrigerant to the other one of the cylinders is provided. In the cases, when the branch flow channel is formed by a suction hole which extends along an axial direction of a rotary shaft, the suction flow channel loss of the gas refrigerant becomes large, and may cause degradation of the performance of the rotary compressor. In order to reduce suction flow passage loss, it may be considered to form a branch flow channel of an inclination hole which is inclined with respect to an axial direction. However, a rotary compressor having an inclination hole shows low manufacturability, and may cause increase of manufacturing cost or lowering quality due to production of burrs.

On the other hand, in the embodiment, as shown in FIG. 3, the center 81*c* of the first suction hole 81 is located more outside in the radial direction R than the center 82*c* of the second suction hole 82. According to the configuration, the branched angle of the second suction passage 72 with respect to the first suction passage 71 can be made to incline with respect to the axial direction Z substantially, even if the first suction hole 84 and the second suction hole 82 are those provided in the axial direction Z. Accordingly, a configuration similar substantially to a case where an inclination hole is provided can be realized, and thus reduction of suction flow passage loss can be decreased. Since the first suction hole 81 and the second suction hole 82 are those provided in the axial direction Z, the manufacturability is enhanced and lowering of quality can also be suppressed due to production of burrs. Thus, a rotary compressor of high performance, high quality and low cost can be provided.

With reference to FIG. 3, functions and effects of the annular groove 61 and the elastic portion 62 formed in the main bearing 54 and the annular groove 63 and the elastic portion 64 formed in the sub-bearing 55 will be explained. At the time of driving the rotary compressor 2, the rotary shaft 31 is supported rotatably by the main bearing 54 and the sub-bearing 55, and rotates. When the rotary shaft 31 is rotated, a force in the radial direction R acts on the rotary shaft 31 by a pressure difference between the suction chambers and the compression chambers, and the rotary shaft 31 becomes in a state where the rotary shaft 31 bends in a shape of a character "<" with the compression mechanism portion 33 centered. When the rotary shaft 31 bends in the shape of the character "<", the inclined angle of a portion of the rotary shaft 31 in the main bearing 54 becomes small and the contact surface pressure of the main bearing 54 and the rotary shaft 31 becomes smaller than the contact surface pressure of the sub-bearing 55 and the rotary shaft 31, because the contact length between the main bearing 54 and the rotary shaft 31 is larger than the contact length of the sub-bearing 55 and the rotary shaft 31. Accordingly, the elastic portion 62 is made long so that the elastic portion 62 and the rotary shaft 31 may made to contact with each other with a small contact surface pressure and a long contact distance, by making the thickness of the elastic portion 62 same within a range from the base portion to the tip portion and by making the depth of the annular groove 61 in the axial direction Z larger than the depth of the annular groove 63 in the axial direction Z. By the configuration, lubricity can be enhanced and attrition can be reduced.

Figure 6:
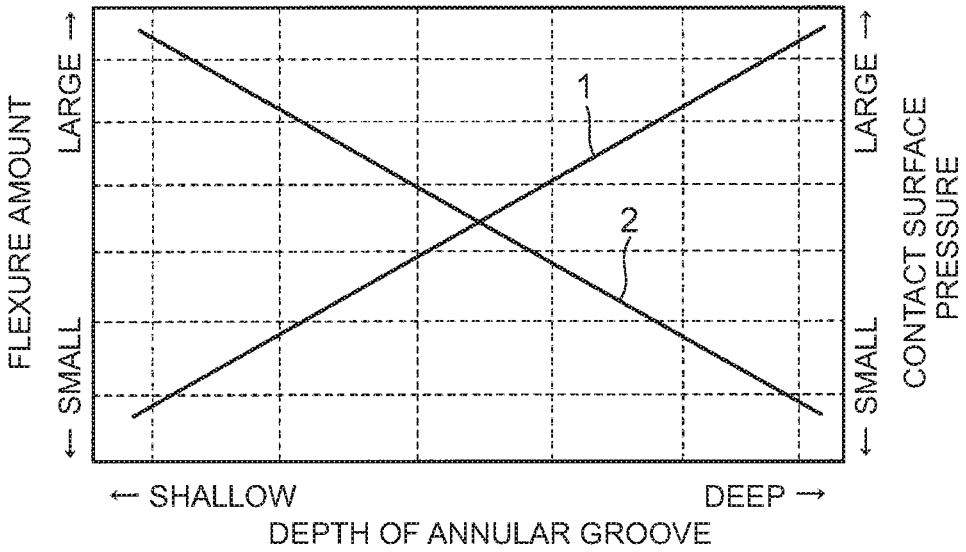
FIG. 6 shows graphs which show relationships between a depth dimension of an annular groove and a flexure amount of a rotary shaft and between the depth dimension of the annular groove and a contact surface pressure of the the rotary shaft and a bearing, respectively.

FIG. 6 shows a graph which shows a theoretical relationship among a flexure or bending amount of the rotary shaft 31, a contact surface pressure between of the rotary shaft 31 and the main bearing 54, and a depth of the annular groove 61. A line 1 shows the flexure amount, and a line 2 shows the contact surface pressure. From the graph, it is found that the flexure or bending amount of rotary shaft 31 becomes large and the contact surface pressure becomes small, as the depth of the annular groove 61 becomes large.

The sub-bearing 55 has a small contact width with the rotary shaft 31, and the bending angle of the rotary shaft 31 is large. Accordingly, when the annular groove formed in the sub-bearing 55 is made in a straight shape similar to that of the annular groove formed in the main bearing 54, the rotary shaft 31 and the sub-bearing 55 may not contact with each other uniformly within the whole contact width, and a portion where a contact surface pressure between the rotary shaft 31 and the sub-bearing 55 rises steeply may become easy to be produced. Thus, by forming the outer peripheral surface of the elastic portion 64 formed in the sub-bearing 55 in a tapered shape, the rigidity of the elastic portion 64 is made large gradually toward the depth direction of the annular groove 63, and the contact surface pressure is made uniform within the whole contact range with the rotary shaft 31.

On the other hand, when the depth of the annular groove 63 is made large, the rigidity of the sub-bearing 55 falls and a holding force for holding the rotary shaft 31 perpendicularly lowers. Accordingly, in order to enhance the holding force, the depth of the annular groove 63 is made shallower than the depth of the annular groove 61.

As shown in FIG. 5, the thickness t2 of the elastic portion 64 is formed thinner than the thickness t1 of the elastic portion 62. By the configuration, slimming of the thickness dimensions of the main bearing 54 and the sub-bearing 55 can be attained and the rigidity of the sub-bearing 55 can be enhanced.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A rotary compressor, comprising:

a rotary shaft;

an electric motor portion connected with one end of the rotary shaft;

a compression mechanism portion connected with the other end of the rotary shaft and including a cylinder which has a cylinder chamber formed inside the cylinder and a main bearing and a sub-bearing to support the rotary shaft rotatably, the main bearing being positioned at a side of the cylinder chamber which is directed to the electric motor portion, the sub-bearing being positioned at a side of the cylinder chamber which is opposite to the electric motor portion; and a hermetic case which houses the rotary shaft, the electric motor portion and the compression mechanism portion, wherein the diameters of portions of the rotary shaft supported by the main bearing and the sub-bearing are formed to be the same substantially, the contact length of the main bearing and the rotary shaft along an axial direction of the rotary shaft is set to be larger than the contact length of the sub-bearing and the rotary shaft along the axial direction of the rotary shaft, an annular groove is formed at an end portion of the main bearing on a side facing the cylinder chamber, an elastic portion which contacts the rotary shaft is formed at an inner peripheral side of the annular groove of the main bearing, another annular groove is formed at an end portion of the sub-bearing on a side facing the cylinder chamber, and an elastic portion which contacts the rotary shaft is formed at an inner peripheral side of the annular groove of the sub-bearing, and wherein the depth of the annular groove of the main bearing is formed to be larger than the depth of the annular groove of the sub-bearing, an outer peripheral surface of the elastic portion of the main bearing is formed in a straight shape so that thicknesses of a base portion and a tip portion of the elastic portion are the same substantially, and an outer peripheral surface of the elastic portion of the sub-bearing is formed in a tapered shape so that a thicknesses of a base portion of the elastic portion is larger than a thicknesses of a tip portion of the elastic portion.

2. The rotary compressor according to claim 1, wherein the thickness of the base portion of the elastic portion of the sub-bearing is formed larger than the thickness of the elastic portion of the main bearing, and the thickness of the tip portion of the elastic portion of the sub-bearing is formed smaller than the thickness of the elastic portion of the main bearing.

3. The rotary compressor according to claim 1, wherein the cylinder includes a first cylinder having a first cylinder chamber and a second cylinder having a second cylinder chamber, and a divider plate is provided between the first cylinder and the second cylinder.

4. The rotary compressor according to claim 3, wherein a first suction hole is provided in the first cylinder adjacently to the divider plate, a second suction hole is provided in the divider plate, a suction passage is provided in the second cylinder, the first suction hole, the second suction hole and the suction passage communicate with one another, and the center of the first suction hole is positioned apart from the center of the second suction hole toward an outside in a radial direction of the rotary shaft.

5. A refrigerating cycle device, comprising:

a rotary compressor according to claim 1;

a radiator connected to the rotary compressor;

an expansion device connected to the radiator; and a heat sink connected between the expansion device and the rotary compressor.

6. A refrigerating cycle device, comprising:

a rotary compressor according to claim 2;

a radiator connected to the rotary compressor;

an expansion device connected to the radiator; and a heat sink connected between the expansion device and the rotary compressor.

7. A refrigerating cycle device, comprising:

a rotary compressor according to claim 3;

a radiator connected to the rotary compressor;

an expansion device connected to the radiator; and a heat sink connected between the expansion device and the rotary compressor.

8. A refrigerating cycle device, comprising:

a rotary compressor according to claim 4;

a radiator connected to the rotary compressor;

an expansion device connected to the radiator; and a heat sink connected between the expansion device and the rotary compressor.

* * * * *